US005471702A

United States Patent [19]

Schmitt

[11] Patent Number: 5,471,702

[45] Date of Patent: Dec. 5, 1995

[54] TOOTHBRUSH WITH LATERAL STROKE CORRECTING FEATURES

[75] Inventor: William Schmitt, Branford, Conn.

[73] Assignee: Chesebrough-Pond's USA Co., Division of Conopco, Inc., Greenwich, Conn.

[21] Appl. No.: 372,270

[22] Filed: Jan. 13, 1995

[51] Int. Cl.[6] ..... A46B 9/04

[52] U.S. Cl. ..... 15/167.1; 15/201

[58] Field of Search ..... 15/144.1, 167.1, 15/167.2, 172, 201–203

[56] References Cited

U.S. PATENT DOCUMENTS

| | | | |
|---|---|---|---|
| D. 322,893 | 1/1992 | Kihara | D4/104 |
| 1,288,349 | 12/1918 | Wise | 15/203 |
| 1,709,262 | 4/1929 | Henderhan | 15/167.2 |
| 2,273,207 | 2/1942 | Kuhn | 15/167.1 |
| 2,797,426 | 7/1957 | Donee | 15/203 |
| 4,472,853 | 9/1984 | Rauch | 15/167.1 |
| 4,776,054 | 10/1988 | Rauch | 15/167.1 |
| 4,864,676 | 9/1989 | Schaiper | 15/167.1 |
| 5,184,368 | 2/1993 | Holland | 15/167.1 |
| 5,269,038 | 12/1993 | Bradley | 15/167.1 |
| 5,305,491 | 4/1994 | Hegemann | 15/167.2 |

FOREIGN PATENT DOCUMENTS

| | | | |
|---|---|---|---|
| 707727 | 7/1931 | France | 15/201 |
| 488169 | 7/1938 | United Kingdom | 15/202 |
| 2192784 | 1/1988 | United Kingdom | 15/167.2 |
| 93-13691 | 7/1993 | WIPO | 15/167.2 |

*Primary Examiner*—Mark Spisich
*Attorney, Agent, or Firm*—Milton L. Honig

[57] ABSTRACT

A toothbrush is provided that includes a handle formed with an elongated cavity and a mouth opening at a terminus thereof. At least two stems consisting of a bar and a brushhead are hingedly supported at a first end of each bar within the elongated cavity. The toothbrush enables a user despite incorrect stroking to convert lateral motion into a corrected up and down movement of the bristles.

10 Claims, 3 Drawing Sheets

TOOTHBRUSH WITH LATERAL STROKE CORRECTING FEATURES

BACKGROUND OF THE INVENTION

1. Field of the Invention

The invention concerns a toothbrush that self corrects a user's improper lateral stroking practice into dentist recommended up and down motion of the bristles.

2. The Related Art

Oral care professionals promote brushing that simulates a rolling action. Brush strokes that move up and down are recommended so that the bristles can contact intratooth crevices and massage rather than hurt the gingival (gum) margins. Most people, even though they know it is the incorrect way to brush, practice a lateral in and out stroke which for ergonomic reasons is more natural.

A partial solution to incorrect stroking is use of segmented brushheads. The literature has reported a variety of segmented head toothbrushes. For instance, U.S. Pat. No. 4,776,054 (Rauch) describes a toothbrush for efficient cleaning of the teeth, the area under the sulcus and between the teeth and for massage and stimulation of the gums. In one of its embodiments (FIGS. 8–9), the patent describes a brushhead formed with several slits to effect the flexibility of outer brushhead segments.

U.S. Pat. No. 4,472,853 (Rauch) describes through FIGS. 9–11 certain embodiments involving a brush body with flexible members of segments which permit the bristles to retract when force is applied to their ends.

U.S. Pat. No. 4,864,676 (Schaiper) describes a brushhead formed of a plurality of head sections being resiliently movable relative to each other and each being provided with one or more bristle tufts.

U.S. Pat. No. 5,184,368 (Holland) discloses a toothbrush that includes a plurality of bristle holders spring-urged outwardly from the brushhead. In certain of the embodiments, the brushhead is pivotally mounted to the handle.

U.S. Pat. No. 5,269,038 (Bradley) reports on a toothbrush that provides side-to-side stroking action in concert with an up-down motion. The brushhead includes two pair of elongate bristle-carrying pads hingedly attached to the head by a relatively thin web having an hour-glass cross sectional shape.

Even though there have been many disclosures directed at improving toothbrushes, there still is room for further innovation. The art has not totally resolved the primary problem of reaching all tooth surfaces, which are a series of complex curves, gaps and valleys within and between teeth. These surfaces cannot be reached by prior art brushheads since these are limited in their total deflection. Neither have the brushes of the prior art been able to totally resolve incorrect brushing technique practiced by many users.

Accordingly, it is an object of the present invention to provide a toothbrush with improved characteristics for reaching the entirety of tooth surfaces.

It is another object of the present invention to provide a toothbrush that enables a user despite incorrect stroking to convert lateral motion into a corrected up and down movement of the bristles.

These and other objects of the present invention will become more apparent through consideration of the following summary, detailed description and drawing.

SUMMARY OF THE INVENTION

A toothbrush is provided that includes:

a handle having first and second terminii opposite one another, the handle including an elongated cavity with a mouth opening at the first terminus; and at least two stems each consisting of a bar and a brushhead, the bar having first and second ends, the first end resiliently supported by a retaining member within the cavity of the handle, the brushhead being located at the second end, the brushhead including a head surface fitted with a plurality of bristle tufts oriented orthogonal thereto.

Furthermore, toothbrushes of the present invention may include a pivoting device within the cavity to allow movement of the at least two stems either in a plane parallel or perpendicular to a plane of the handle. Preferably, the pivoting device is a post.

Advantageously the bars of the at least two stems are formed together unitarily at the first ends thereof. The number of stems may range anywhere from two to eight. Especially desirable is where the bar and brushhead of each of the at least two stems have an identical width and depth.

In one embodiment of the present invention, the plurality of the bristle tufts of each of the at least two stems all form a single row along an elongated length of the brushhead.

BRIEF DESCRIPTION OF THE DRAWING

The above features, advantages and objects of the present invention will more fully be appreciated through the following drawing consisting of.

DETAILED DESCRIPTION

Figure 1:
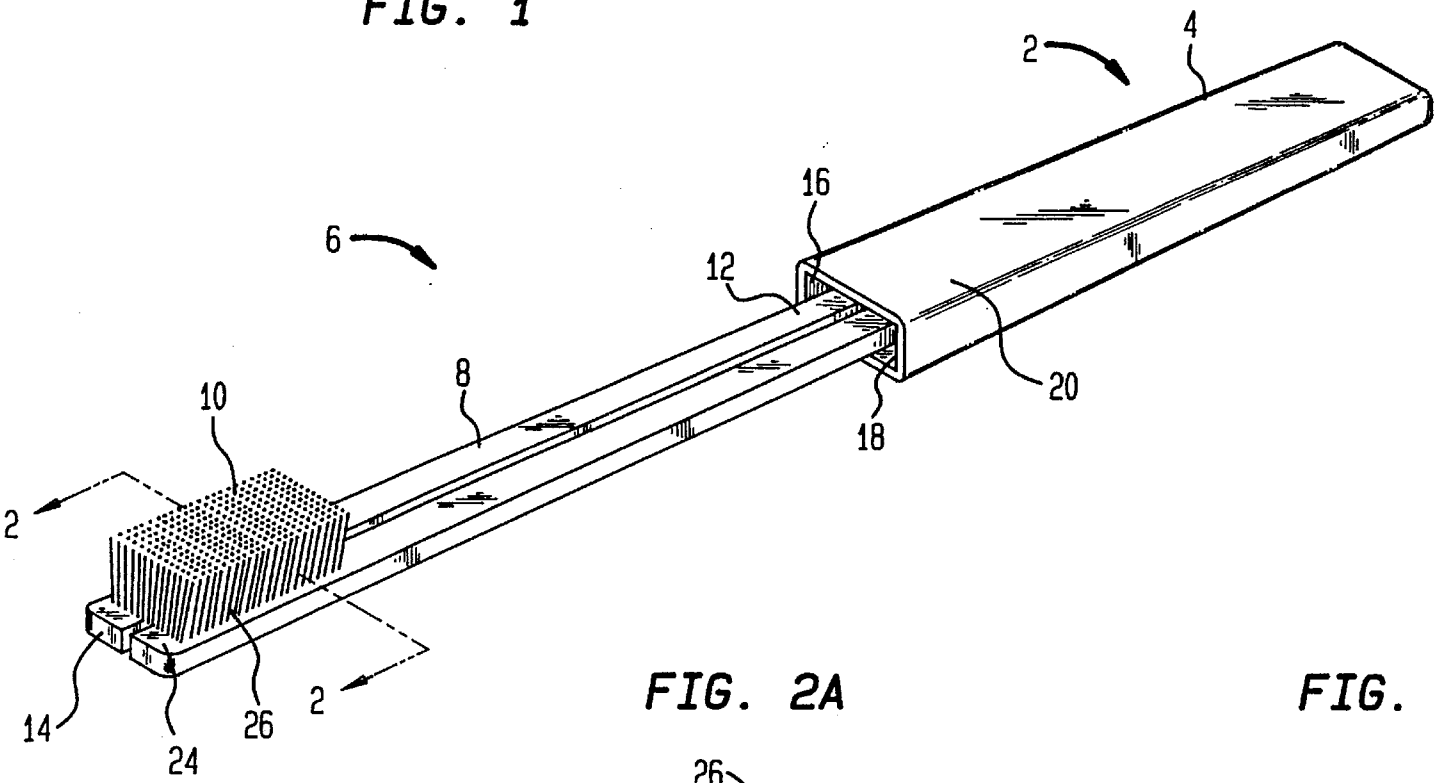
FIG. 1 which is a plan perspective view of a first embodiment of toothbrushes according to the present invention.
Figure 2:
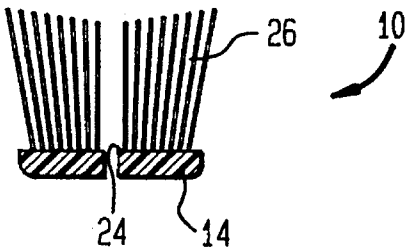
FIG. 2 which is an enlarged cross-sectional view taken along lines 2—2 of FIG. 1.
Figure 2A:
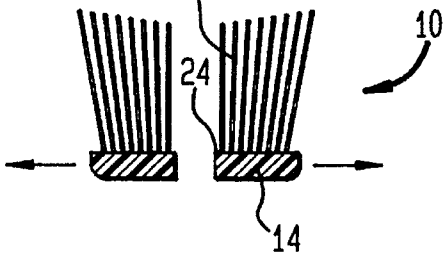
FIG. 2A which is an identical view to that of FIG. 2, except demonstrating the relative position of the stems in their outward movement.

FIGS. 1 through 5 illustrate a first embodiment of toothbrushes according to the present invention. Toothbrush 2 includes a handle 4 and at least two stems 6, the latter consisting of a bar 8 and a brushhead 10. Bar 8 has first and second ends 12, 14, respectively. Handle 4 includes an elongated cavity 16 provided with a mouth opening 18 at a first terminus 20 of the handle. First end 12 of bar 8 is resiliently supported by a retaining member 22 within cavity 16 of the handle 4. Brushhead 10 is located at the second end 14 of bar 8 and includes a head surface 24 fitted with a plurality of bristle tufts 26 oriented orthogonal to the head surface.

A pivoting device 28, such as a post 30, may be employed to anchor the stems 6 and to allow movement of the stems in a plane parallel to the plane of the handle.

Figure 3:
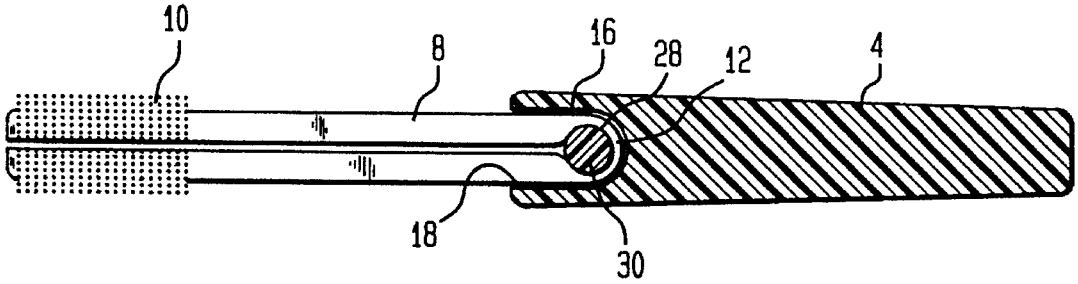
FIG. 3 which is a top plan view of the toothbrush according to FIG. 1, except that the handle area covering the post is partially removed.
Figure 5:
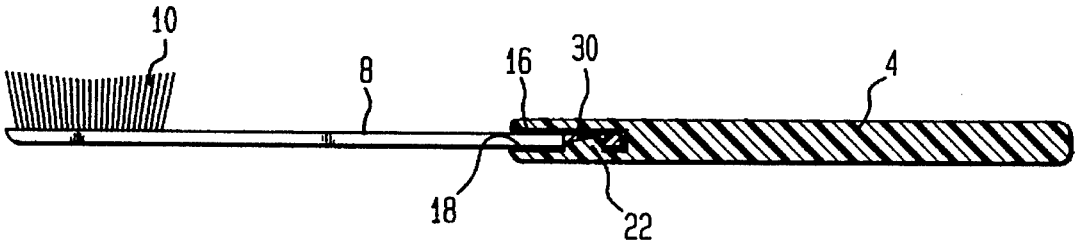
FIG. 5 which is a side elevational view according to FIG. 1, except that the handle is partially exposed.
Figure 4:
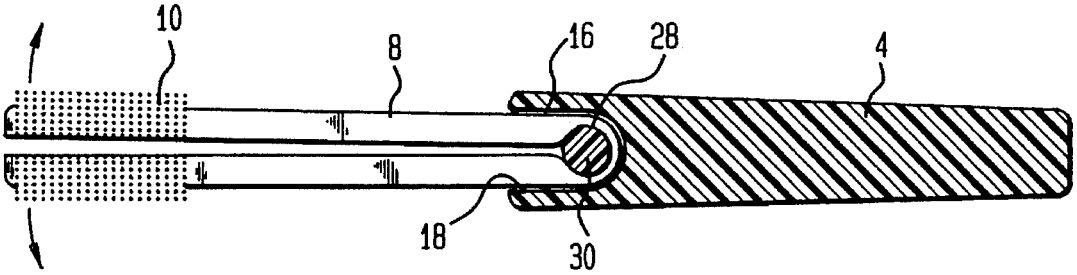
FIG. 4 which is identical to FIG. 3 except demonstrating the lateral flexing of the stems.

Advantageously the bars of the at least two stems are formed together unitarily at the first ends 12 thereof. FIG. 3 illustrates the unitary construction of the bars and how they wrap around post 30. When brushing, stems 6 may move together laterally to either side. Dependent on the tightness of the pivoting device, each of the pair of stems, as best illustrated in FIG. 4, also have at least some lateral movement away from each other. Such movements will also be dependent on the pressure applied by a user against the handle and on the topography of the specific teeth being brushed. FIG. 5 illustrates the retaining member 22 which, in combination with the pivoting device 28, prevents the stem from movement outside the cavity 16 of the handle.

Figure 6:
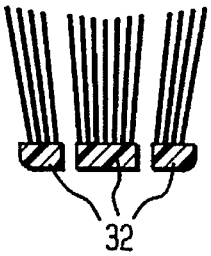
FIG. 6 which is a second embodiment of the invention according to FIG. 1 wherein there are three stems.

The number of stems may range anywhere from two to eight. FIG. 6 illustrates an embodiment where there are three stems 32. Especially desirable is where the bar and brushhead of at least two stems have an identical width and depth.

Figure 7:
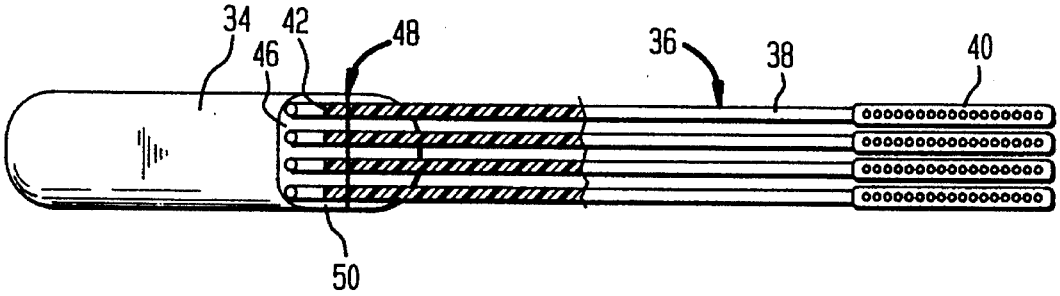
FIG. 7 which is a bottom plan view, with handle area covering the pivoting device removed, illustrating a third embodiment of toothbrushes according to the present invention.
Figure 8:
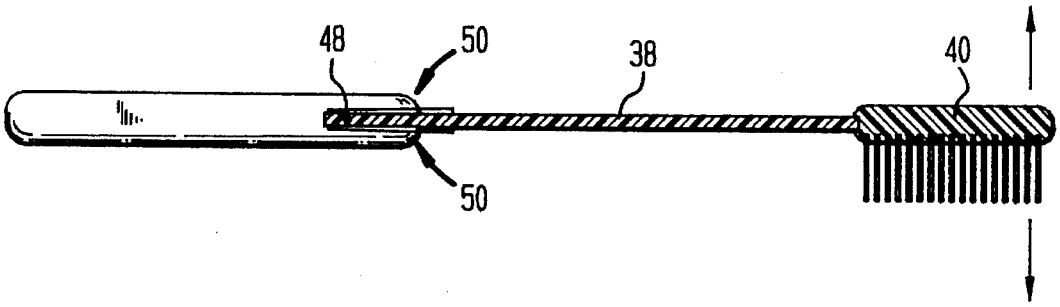
FIG. 8 which is a side elevational view, again with the handle area covering the pivoting device removed, according to the embodiment of FIG. 7.
Figure 9:
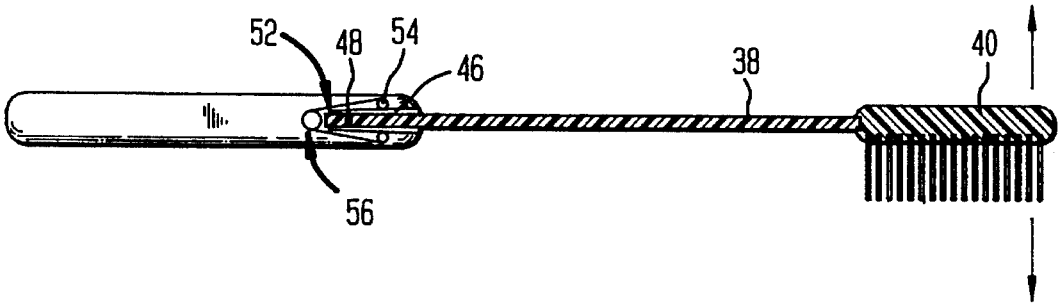
FIG. 9 which is a side elevational view similar to that of FIG. 8, except disclosing a different spring mechanism.

A third embodiment according to the present invention is illustrated in FIGS. 7–9. This embodiment includes a handle 34 and four stems 36, each of the stems being formed by a bar 38 and a brushhead 40.

A first end 42 of bar 38 is held within a cavity 46 of the handle 34. A post 48 is anchored to walls of the cavity and traverses through each of the bars at first end 42 thereof perpendicular to the longitudinal axis of the stems. A spring 50 surrounds the first end of each of the bars. The springs may be separate from the cavity walls or molded to these walls or to the bar ends. FIG. 9 illustrates a spring system 52 that includes a pair of lateral springs 54 on opposite major surfaces of bar 38 and a dorsal spring 56 positioned behind the end of bar 38. The spring system allows bar 38 to achieve additional vertical play within cavity 46.

The primary objective of the present invention is to reach all tooth surfaces which are a series of complex curves, gaps and valleys within and between teeth. Most brushheads have limited total deflection. The present invention recognizes the physical parameters involved and provides a brush with improved capability to reach all tooth surfaces. The factors involved are: toothlength, depth of contours and valleys, mechanical flexibility of the brush stems and force used in brushing. With respect to the latter parameter, toothbrushing forces may range between 450 g and 1400 g. These forces are discussed by Burgett and Ash in *J. Periodontol.*, Vol. 45, 1974, pages 410–413; by Heath and Wilson in *Biomedical Engineering*, February 1974, pages 61–64; and by Fraleigh, McElhaney and Heisen in *J. Dent. Res.*, Jan–Feb., 1967, pages 209–214.

Distances between teeth range between 1 and 4 mm with an average of 2.25 mm. These distances are outlined in Table I below. On the basis of these toothbrush forces and average distance between teeth, the resiliency, pivoting and spring forces can be arranged so as to best provide for optimal movement of the brushheads along the dental topography. For instance, vertical play of the stems should best average about 2.25 mm. Vertical play can be controlled by setting the appropriate tensions on spring 50 or the spring system 52.

TABLE 1

| | LOWER mm | UPPER mm |
|---|---|---|
| Between 2 First Incisors | 1 | 1 |
| Between 1st and 2nd Incisors | 1 | 1.5 |
| Between 2nd Incisor & Canine | 1.5 | 2 |
| Between Canine and 1st Premolar | 2.5 | 2 |
| Between 1st and 2nd Premolar | 4 | 2.5 |
| Between 2nd Premolar and 1st Molar | 3 | 3.5 |
| Between 1st and 2nd Molar | 3 | 2.5 |
| Between 2nd and 3rd Molar | 3 | |
| TOTAL | 19 =2.375 avg. | 17 2.125 avg. |
| | 2.25 mm avg. | |

The foregoing description is only illustrative of the principle of the present invention. It is to be understood that the invention is not limited to the exact embodiments illustrated and described herein. Accordingly, modifications can be made which will still be within the scope and spirit of the present invention.

What is claimed is:

1. A toothbrush comprising:

a handle having first and second terminii opposite one another, the handle including an elongated cavity with a mouth opening at the first terminus;

at least two stems each consisting of a bar and a brushhead, each bar having first and second ends, each first end resiliently supported by a retaining mechanism within the cavity of the handle, each brushhead being located at a respective one of the second ends, each brushhead including a head surface fitted with a plurality of bristle tufts oriented orthogonal thereto; and a pivoting means within the cavity to allow movement of the at least two stems, the pivoting means being a post, the bars of the at least two stems being formed together unitarily at each first end thereof to wrap around the post.

2. A toothbrush according to claim 1 wherein the at least two stems are only two stems.

3. A toothbrush according to claim 1 wherein the at least two stems are only three stems.

4. A toothbrush according to claim 1 wherein the bar and brushhead of each of the at least two stems has an identical width and depth.

5. A toothbrush according to claim 1 wherein the plurality of bristle tufts of each of the at least two stems form a single row along an elongated length of the brushhead.

6. A toothbrush comprising:

a handle having first and second terminii opposite one another, the handle including an elongated cavity with a mouth opening at the first terminus;

at least two stems each consisting of a bar and a brushhead, each bar having first and second ends, each first end resiliently supported by a retaining mechanism within the cavity of the handle, each brushhead being located at a respective one of the second ends, each brushhead including a head surface fitted with a plurality of bristle tufts oriented orthogonal thereto; and a pivoting means within the cavity to allow movement of the at least two stems, the pivoting means being a post traversing through the at least two bars in an area of the first ends thereof and being arranged perpendicular to a longitudinal axis of the stems.

7. A toothbrush according to claim 6 wherein the bars of the at least two stems are formed together unitarily at the first ends thereof.

8. A toothbrush comprising:

a handle having first and second terminii opposite one another, the handle including an elongated cavity with a mouth opening at the first terminus;

at least two stems each consisting of a bar and a brushhead, each bar having first and second ends, each first end resiliently supported by a retaining mechanism within the cavity of the handle, each brushhead being located at a respective one of the second ends, each brushhead including a head surface fitted with a plurality of bristle tufts oriented orthogonal thereto; and at least one spring surrounding the first end of each bar.

9. A toothbrush according to claim 8 further comprising a pivoting means within the cavity to allow movement of the at least two stems.

10. A toothbrush according to claim 9 wherein the pivoting means is a post.

* * * * *